US006729256B2

(12) United States Patent
Kochi et al.

(10) Patent No.: US 6,729,256 B2
(45) Date of Patent: May 4, 2004

(54) PERSONAL WATERCRAFT

(75) Inventors: Takao Kochi, Saitama (JP); Tomohisa Abe, Saitama (JP); Bill Orr, Fountain Valley, CA (US)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/341,480

(22) Filed: Jan. 14, 2003

(65) Prior Publication Data

US 2003/0131775 A1 Jul. 17, 2003

Related U.S. Application Data

(60) Provisional application No. 60/347,293, filed on Jan. 14, 2002.

(51) Int. Cl.[7] ..... B63B 35/73
(52) U.S. Cl. ..... 114/55.5; 114/140
(58) Field of Search ..... 114/357, 55.5, 114/55.54, 55.57, 140, 62

(56) References Cited

U.S. PATENT DOCUMENTS 5,582,529 A * 12/1996 Montgomery ..... 441/74
5,902,158 A * 5/1999 Nakase et al. ..... 440/88 R
6,457,433 B1 * 10/2002 Nagata ..... 114/343
2002/0157590 A1 * 10/2002 Bigras ..... 114/55.5

FOREIGN PATENT DOCUMENTS

JP 6-96397 B2 11/1994

* cited by examiner

*Primary Examiner*—Stephen Avila
(74) *Attorney, Agent, or Firm*—Birch, Stewart, Kolasch & Birch, LLP

(57) ABSTRACT

A personal watercraft designed to advance suitably in a forward direction, to prevent an influence of side waves, and to incline to the turning center side when being steered by an operator from a forward direction to a turned direction. The personal watercraft includes a keel provided at a middle portion in the widthwise direction of the bottom of the body and extending from the bow to the stern. The keel is formed in an arc in the widthwise direction of the body. The keel is configured such that, at the rear half portion of the body, the center of the arc of the keel substantially coincides with the position G of the center of gravity of the body. On the other hand, at the front half portion of the body, the radius R2 of the arc of the keel gradually decreases in the forward direction.

14 Claims, 9 Drawing Sheets

PRIOR ART

PRIOR ART

PERSONAL WATERCRAFT

CROSS-REFERENCE TO RELATED APPLICATION

The present application claims priority under 35 U.S.C. §119 to U.S. Provisional Application No. 60/347,293 filed on Jan. 14, 2002, the entire contents of which are hereby incorporated by reference.

BACKGROUND OF THE INVENTION

1. Field of the Invention

This invention relates to a personal watercraft which includes a saddle type seat extending in a forward and backward direction at a middle portion of a body, an operation handle member provided forwardly of the seat, and an arcuate keel provided at a middle portion of a bottom of the body.

2. Description of Background Art

One known example of a personal watercraft is a jet propulsion watercraft having a jet propeller mounted at a rear portion of a body and driven by an engine which takes in water from the bottom and jets the water rearwardly to propel the body.

This personal watercraft includes a keel provided at a middle portion of the bottom and extending forwardly and rearwardly (that is, from the bow to the stern).

FIG. 8 shows a sectional view of a conventional personal watercraft. The personal watercraft 100 is configured such that a keel 101 is formed in such a manner as to project downwardly so that it may project by a comparatively great amount downwardly from a middle portion of a bottom 102.

Since the keel 101 projects downwardly by a comparatively great amount, the straightforwardly advancing property of the personal watercraft 100 can be maintained suitably when it is propelled.

However, where the keel 101 projects downwardly by a comparatively great amount, for example, if the personal watercraft 100 is acted upon by a side wave while it glides, then the keel 101 is liable to be influenced by the side wave. Since the keel 101 is influenced by a side wave in this manner, the personal watercraft 100 tends to roll leftwardly or rightwardly.

An example of a personal watercraft which is not influenced by a side wave, is shown a "Personal Jet Propulsion Watercraft" of the official gazette of Japanese Patent Publication No. Hei 6-96397. In the following, this personal watercraft is described in detail with reference to the succeeding figures (FIGS. 9 and 10) derived from FIGS. 1 and 4(A), respectively, shown in the official gazette. Note, however, that the reference numerals are re-numbered.

FIG. 9 is a sectional view showing a first example of a conventional personal watercraft which is less susceptible to being influenced by a side wave. The personal watercraft 110 is configured such that a keel 111 is formed flat so as not to project downwardly from a bottom 112.

According to this personal watercraft 110, even when it is acted upon by a side wave while it glides, the keel 111 is influenced comparatively little by a side wave. Therefore, the personal watercraft 110 does not roll leftwardly or rightwardly.

FIG. 10 is a plan view showing a second example of a conventional personal watercraft which is less susceptible to be influenced by a side wave. As a crew-member 115 of the personal watercraft 110 operates an operation handle member 116 as indicated by an arrow mark b, a steering nozzle (not shown) of a body rear portion 117 is swingably moved.

Consequently, a water jet 118 jetted from the steering nozzle is directed obliquely as indicated by an arrow mark c so that the personal watercraft 110 turns as indicated by an open arrow mark.

However, if the keel 111 is formed flat as not to be influenced by a side wave, then when the personal watercraft 110 is turned, the body is pushed by water from a sideward direction and the body tends to incline inwardly. However, since the bottom is formed flat, when the body begins to incline, the flat face of the body acts as resistance and the body is less likely to incline.

Therefore, it would be desirable to construct the personal watercraft 110 in such a manner that it could incline readily when the body begins to incline upon turning. With such a design, the personal watercraft 110 could be placed into a turning condition from a straightforwardly advancing condition, while maintaining a natural feeling for the operator, for example, similar to the natural feeling provided an operator of a motorcycle during a turning operation.

SUMMARY AND OBJECTS OF THE INVENTION

Therefore, the object of the present invention is to provide a personal watercraft which suitably assures a straightforwardly advancing property, and which also prevents the influence of a side wave, and inclines readily when the personal watercraft is turned.

In order to attain the object described above, according to the first aspect of the present invention, a personal watercraft is provided with a saddle type seat extending in a forward and backward direction at a middle portion of a deck of a body, an operation handle member provided forwardly of the seat, a pair of foot decks formed on the opposite sides of the seat, and a keel provided at a middle portion of a bottom of the body and extending from a bow to a stern. The keel extends in the forward and backward direction of the body and is formed in an arc. In addition, at a location rearward of the center of the body, the center of the arc of the keel substantially coincides with the height of the position of the center of gravity of the body.

At the portion of the body rearward of the center of the body, the center of the arc of the keel substantially coincides with the height of the position of the center of gravity of the body. Consequently, the radius of the arc of the keel can be made large. As the radius of the arc of the keel becomes large, the keel can be prevented from projecting downwardly by a great amount from the bottom. Since the projecting amount of the keel is suppressed in this manner, the keel is less likely to be influenced by a side wave so that the body can be prevented from rolling leftwardly or rightwardly by an influence of a side wave.

Further, since the center of the arc of the keel substantially coincides with the height of the position of the center of gravity of the body, when a crewmember performs a steering operation and the body turns its direction from a forwardly advancing direction to a turning direction and is pushed by water from a sideward direction, whereupon the body begins to incline toward the center of the turning movement, the body can incline around the height of the position of the center of gravity. Therefore, the body can incline readily when the watercraft turns.

Consequently, since the body can incline smoothly toward the center of the turning movement by a natural movement, the posture of the personal watercraft can smoothly change from an uprightly standing posture to an inclined posture when the watercraft is turned, providing an operator with the same sense as an operator of a motorcycle feels when the motorcycle turns.

According to a second aspect of the present invention, the radius of the arc of the keel gradually decreases forwardly at a location forward of the center of the body.

Since, at the portion of the body forward of the center of the body, the radius of the arc of the keel gradually decreases forwardly, the keel at the portion of the body forward of the center of the body can be made project by a comparatively great amount from the bottom.

Consequently, since the plowing property by the keel when the personal watercraft advances straightforwardly can be improved, when the personal watercraft is hit by a high wave during gliding thereof, the impact provided to the body can be kept low, and driving comfort can be maintained.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
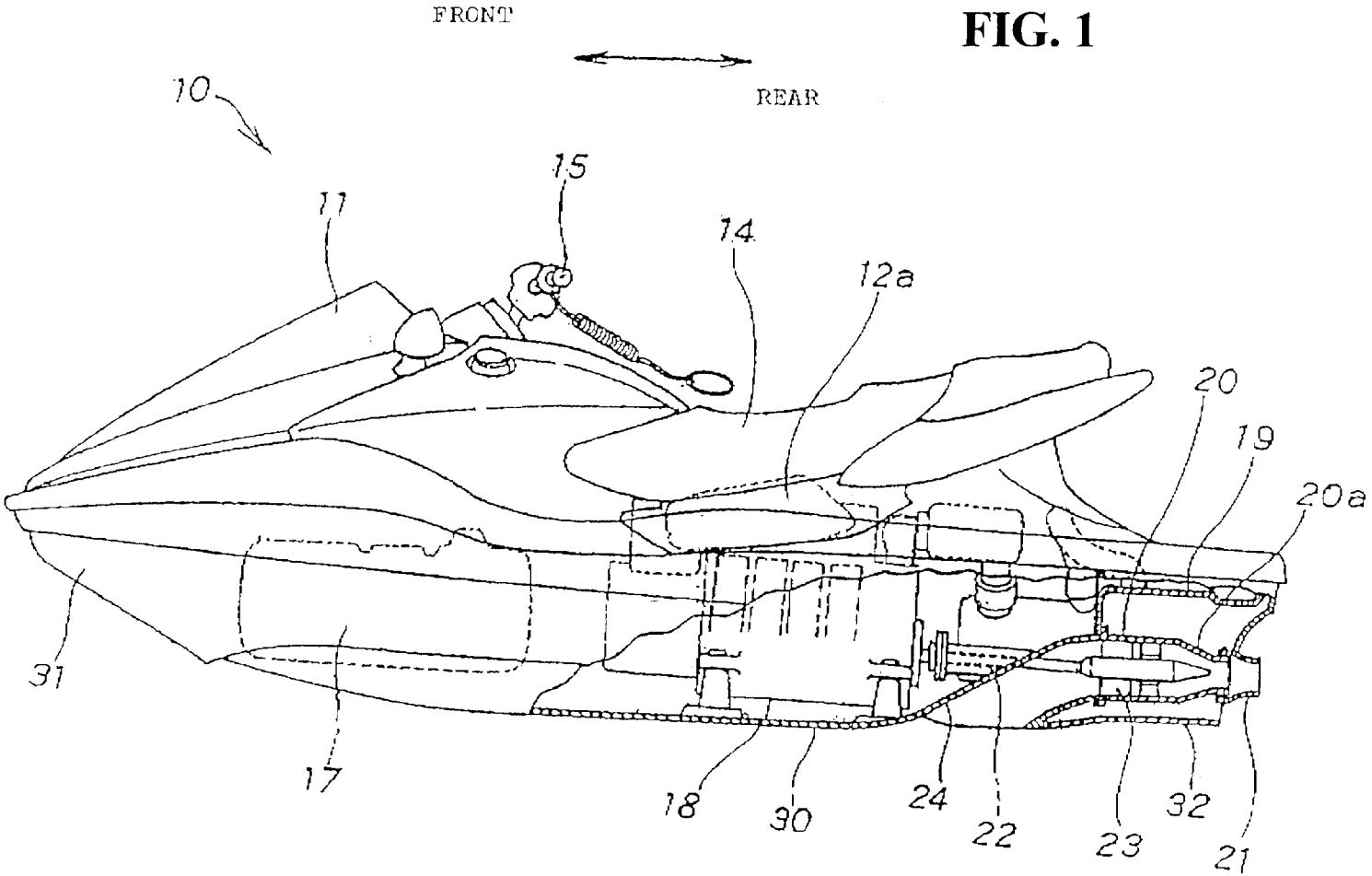
FIG. 1 is a side elevational view of a personal watercraft according to the present invention.

An embodiment of the present invention is described below with reference to the accompanying drawings. Here, the terms "front", "rear", "left" and "right" are defined as directions as viewed from the driver. Further, the drawings should be viewed in the direction of the reference characters.

FIG. 1 is a side elevational view of a personal watercraft according to the present invention.

Figure 4B:
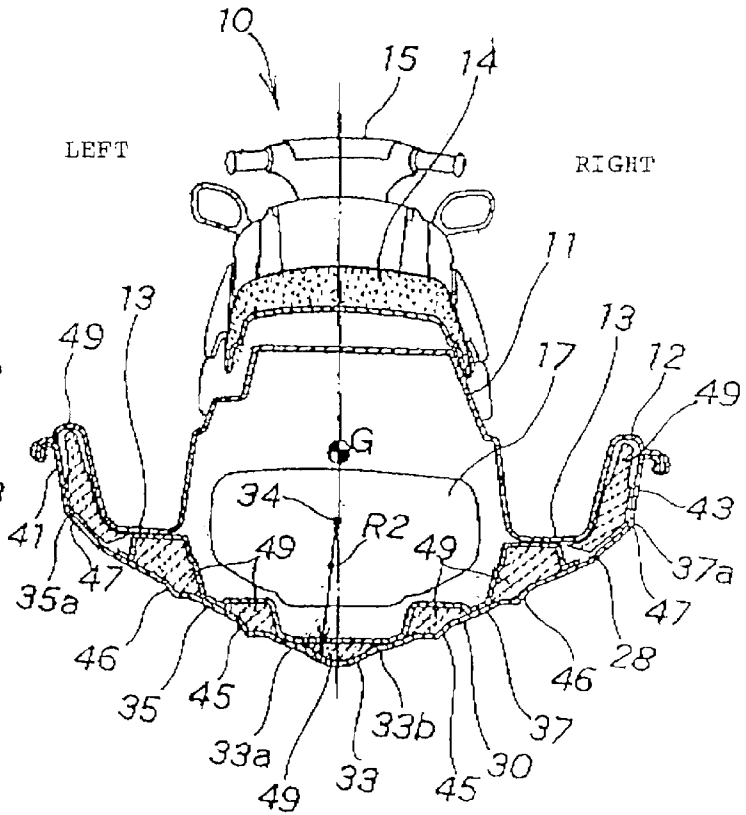
FIGS. 4(*a*) and 4(*b*) are sectional views of FIG. 3(*a*) according to the present invention.
Figure 4A:
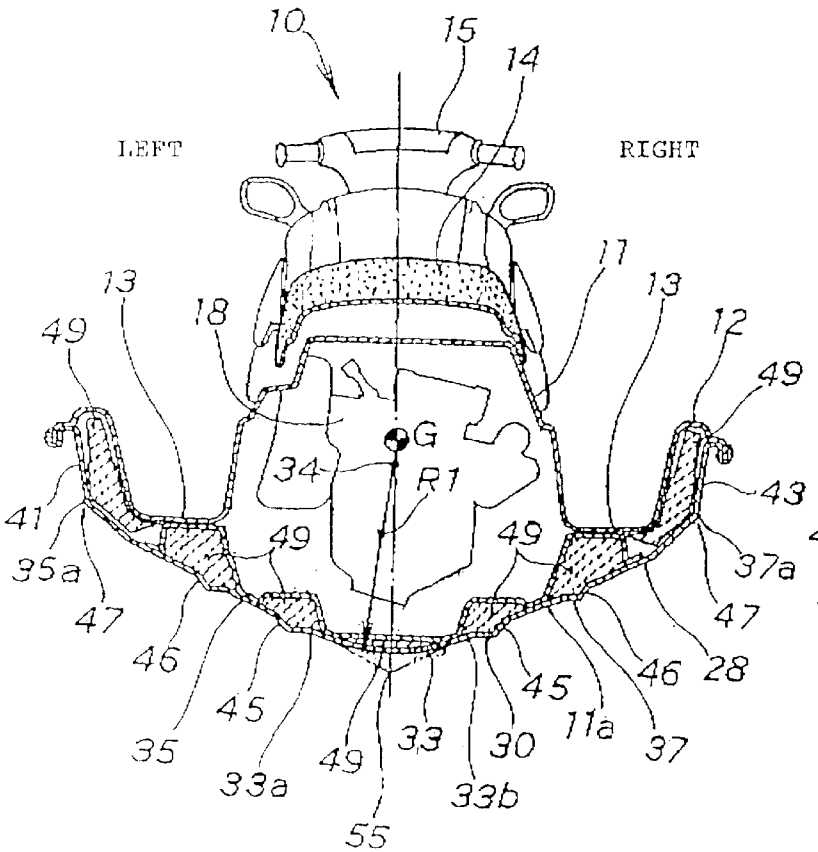

The personal watercraft 10 is a water jet propulsion watercraft configured such that a saddle type seat 14 extending in a forward and rearward direction is provided at a deck middle portion 12*a* of a body 11, an operation handle member 15 is provided forwardly of the seat 14, and a pair of left and right foot decks 13 (refer to FIGS. 4(*a*) and 4(*b*)) are formed on the opposite sides of the seat 14. Also provided are a fuel tank 17 mounted in the inside of the body 11, an engine 18 provided rearwardly of the fuel tank 17, a jet propeller chamber 19 provided rearwardly of the engine 18, a water jet propeller 20 provided in the jet propeller chamber 19, and a steering nozzle 21 provided rearwardly of the water jet propeller 20. The direction of the steering nozzle 21 is controlled by the operation handle member 15.

According to this personal watercraft 10, a crew-member rides on the seat 14 with the left and right feet thereof placed on the left and right foot decks 13, respectively, and grips the operation handle member 15 with the left and right hands thereof to steer the personal watercraft.

When the engine 18 of the personal watercraft 10 is driven while the crew-member grips the operation handle member 15, rotation of the engine 18 can be transmitted to an impeller 23 through a drive shaft 22 to rotate the impeller 23.

As the impeller 23 is rotated, water is taken in through an intake opening 24 of the bottom 30, and the water is then jetted rearwardly as a water jet from the steering nozzle 21. As the water jet jets rearwardly from the steering nozzle 21, the personal watercraft 10 is propelled forwardly.

Figure 2:
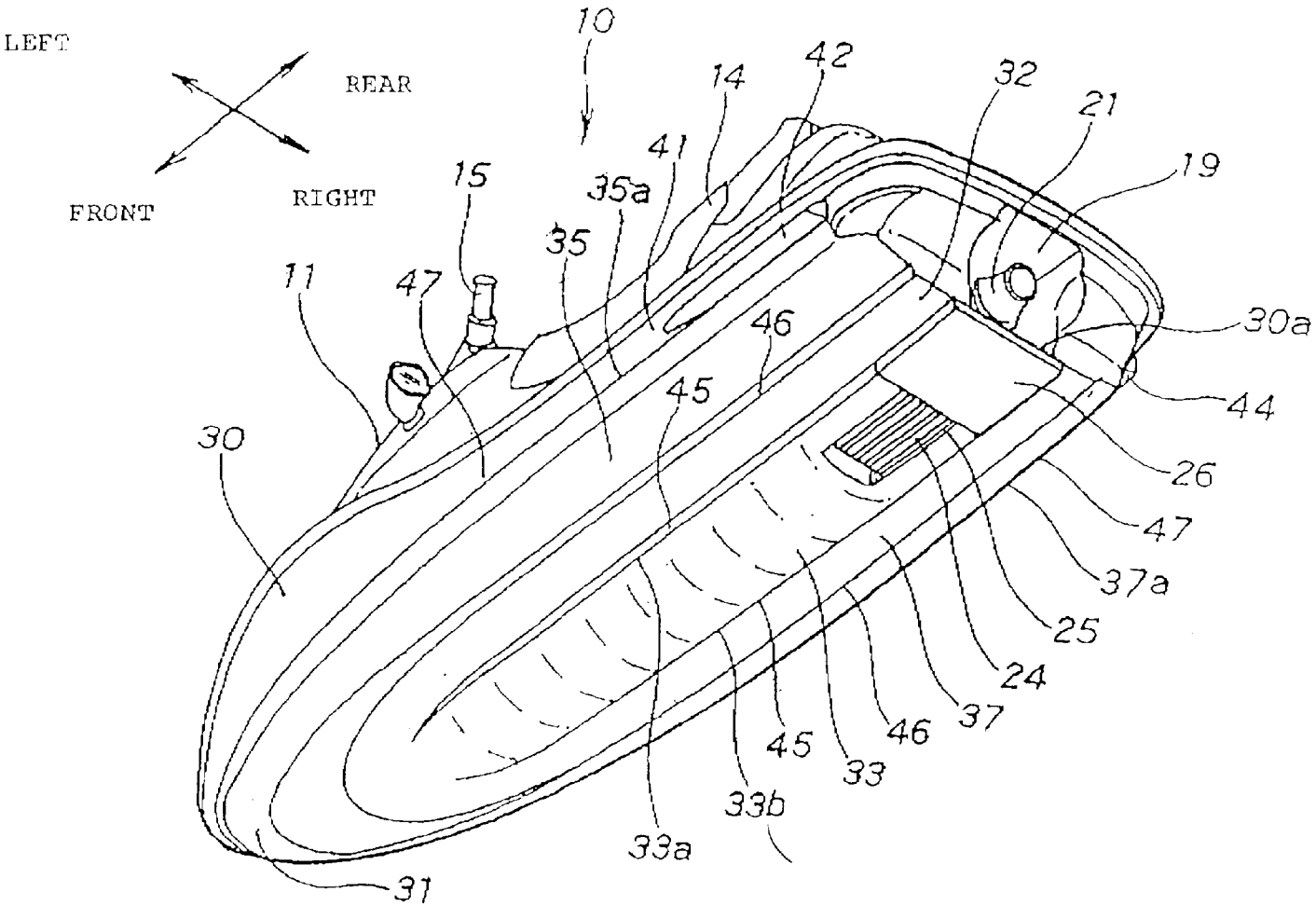
FIG. 2 is an enlarged view of essential part showing essential part of the personal watercraft according to the present invention.

FIG. 2 is an enlarged view of essential part showing essential part of the personal watercraft according to the present invention.

The personal watercraft 10 includes a keel 33 provided at a middle portion in the widthwise direction of the bottom (that is, the watercraft bottom) 30 of the body 11 and extending from the bow 31 to the stern 32. The keel 33 is formed in an arc in the widthwise direction of the body. The personal watercraft 110 has also a pair of left and right inclined faces 35 and 37 extending outwardly in the widthwise direction from respective left and right sides 33*a* and 33*b* of the keel 33, and a pair of left and right wall faces 41 and 43 (the right wall face 43 is shown in FIGS. 4(*a*) and 4(*b*)) extending substantially vertically from outer side 35*a* of the left inclined face 35 and outer side 37*a* of the right inclined face 37, respectively.

The keel 33 has the intake opening 24 adjacent the stern 32. A plurality of grating members 25 are provided in the intake opening 24, and a ride plate 26 is provided rearwardly of the grating members 25.

The under portion of the jet propeller chamber 19 is closed up by covering an opening 30*a* of the bottom 30 with the ride plate 26. The water jet propeller 20 (shown in FIG. 1) is provided in the jet propeller chamber 19, and the steering nozzle 21 is mounted for swinging motion on a jet nozzle 20*a* (at an end portion) of the jet nozzle 20*a*.

The left and right inclined faces 35 and 37 respectively provided on the left and right sides 33*a* and 33*b* of the keel 33 form left and right inner side chines (edges) 45 on the inner sides (that is, on the left and right sides of the keel) 33*a* and 33*b* of the inclined faces 35 and 37, respectively. Also, left and right central chines 46 are formed at middle portions of the left and right inclined faces 35 and 37, and left and right outer side chines 47 are formed on the outer sides 35*a* and 37*a* of the inclined faces 35 and 37, respectively.

On the outer sides 35*a* and 37*a* of the left and right inclined faces 35 and 37, the left and right wall faces 41 and 43 are formed substantially vertically, respectively, and left and right sponsons 42 and 44 are provided at rear portions of the left and right wall faces 41 and 43, respectively.

The left and right sponsons 42 and 44 act as resistance when the body 11 is inclined to a predetermined angle upon turning of the body 11 thereby to prevent the body 11 from being inclined any more and prevent the body 11 from sliding to the outer side by centrifugal force upon turning.

Figures 3A, 3B:
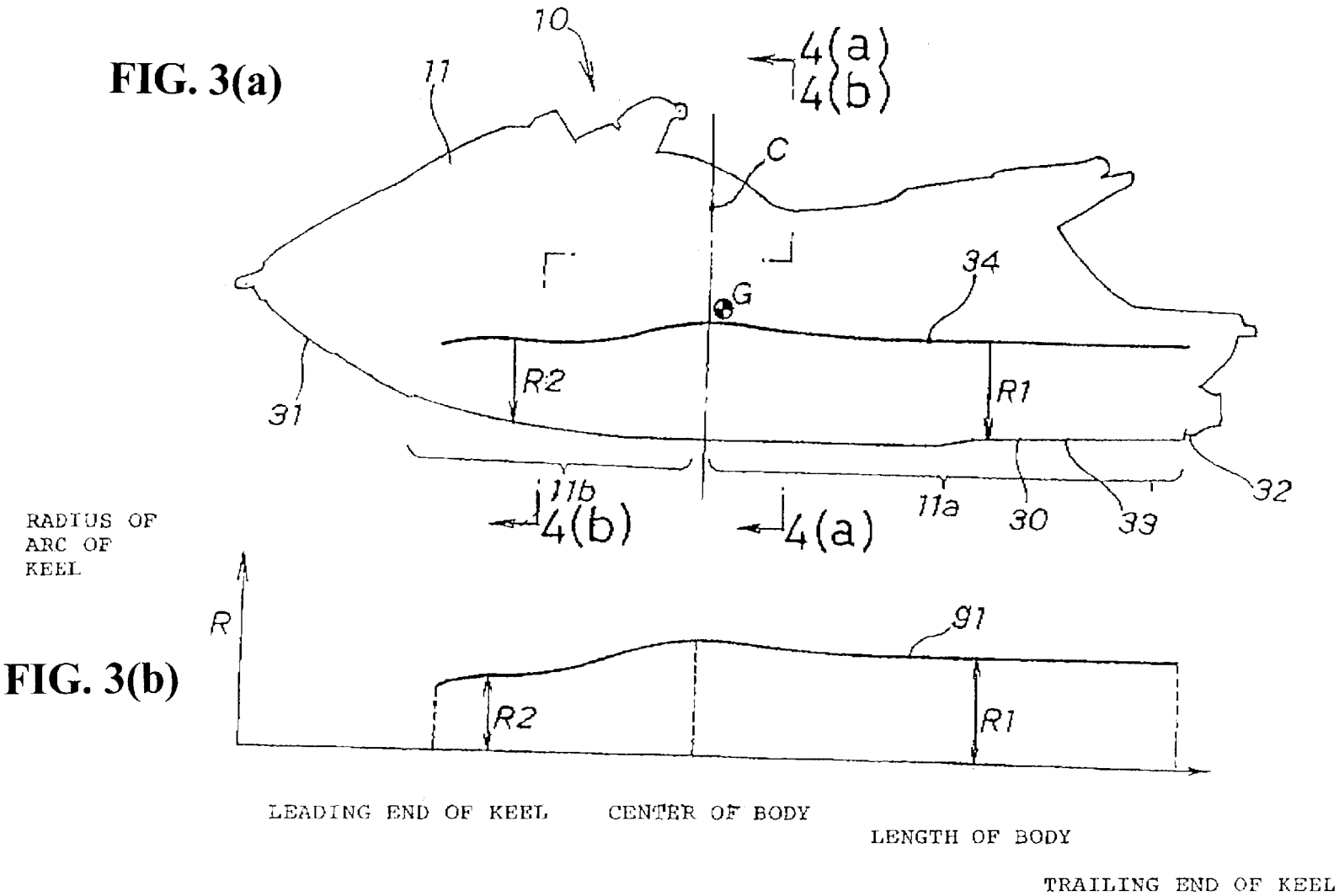
FIGS. 3(*a*) and 3(*b*) are views illustrating the shape of a keel which is a component of the personal watercraft according to the present invention.

FIGS. 3(*a*) and 3(*b*) are views showing the shape of the keel which is a component of the personal watercraft according to the present invention.

FIG. 3(*a*) is a view illustrating the center of the arc of the keel 33. Meanwhile, FIG. 3(*b*) is a view illustrating a radius R of the arc of the keel 33, where the axis of ordinate indicates the radius R of the arc of the keel, the axis of abscissa indicates the length of the body, and the radius R of the arc of the keel is indicated by a graph g1. It is to be noted that the position G of the center of gravity of the personal watercraft 10 represents the position of the center of gravity including the operator or crew-member.

The keel 33 is a member which extends like a belt from the bow 31 to the stern 32 and is formed in an arc in the widthwise direction (refer also to FIG. 2).

This keel 33 is configured such that, at a portion (that is, a rear half portion of the body) 11*a* of the body 11 rearwardly of the center C in the forward and backward direction, the center 34 of the arc of the keel 33 substantially coincides with the height of the position G of the center of gravity of the body 11. On the other hand, at a portion (that is, a front half portion of the body) 11*b* of the body 11 forwardly of the center C, the radius R of the arc of the keel 33 (in the following description, the radius of the arc of the keel on the front half portion 11*b* side is represented as "R2") gradually decreases forwardly.

At the rear half portion 11*a* of the body 11, the center 34 of the radius R of the arc (in the following description, the radius of the arc of the keel at the rear half portion 11*a* is represented as "R1") of the keel 33 substantially coincides with the height of the position G of the center of gravity of the body 11. Consequently, since the center of the radius R1 of the arc of the keel 33 can be set to a comparatively high position, the radius R1 of the arc can be made large.

Since the radius R1 of the arc of the keel 33 of the body 11 is large, the keel 33 does not project downwardly significantly from the bottom 30. Since the projecting amount of the keel 33 is limited, the keel 33 is kept from being influenced by a side wave so that the body 11 is kept from rolling leftwardly or rightwardly by an influence of a side wave.

Further, the keel 33 is configured such that it does not project downwardly by a great amount from the bottom 30 and the center 34 of the arc of the keel 33 substantially coincides with the height of the position G of the center of gravity of the personal watercraft 10. Consequently, when a crew-member 50 (refer to FIGS. 5(*a*) and 5(*b*)) performs a steering operation of the operation handle member 15 and the body 11 turns its direction from a forwardly advancing direction to a turning direction and is pushed by water from a sideward direction, whereupon the body 11 begins to be incline toward the center of the turning movement, the body 11 inclines around the height of the position of the center of gravity. Therefore, the body 11 inclines readily.

Consequently, since the personal watercraft 10 can be made to incline smoothly to the center of the turning movement by a natural movement, the posture of the personal watercraft 10 can be smoothly changed from an uprightly standing posture upon straightforward advancement to an inclined posture upon turning with the same sense as the sense generated during operation of a motorcycle.

At the portion (that is, a front half portion of the body) 11*b* of the body 11 forwardly of the center C, the radius R2 of the arc of the keel 33 is set so as to gradually decrease forwardly. Consequently, since the keel 33 at the front half portion 11*b* can be made project by a comparatively great amount from the bottom 30, the plowing property by the keel 33 when the personal watercraft 10 advances straightforwardly can be improved.

FIGS. 4(*a*) and 4(*b*) are sectional views of FIG. 3(*a*) according to the present invention, and FIG. 4(*a*) is a sectional view taken along line a—a and FIG. 4(*b*) is a sectional view taken along line b—b.

FIG. 4(*a*) shows the rear half portion 11*a* of the body 11. This body 11 is configured such that a lower half portion thereof is formed from a hull 28 and an upper half portion thereof is formed from a deck 12.

The hull 28 is configured such that a middle portion of the bottom 30 is formed from the keel 33, a float member (foamed material) 49 is provided on the rear face of the keel 33; the left and right inclined faces 35 and 37 are extended in an ascending gradient continuously from the left and right sides 33*a* and 33*b* of the keel 33 to the outer sides of the body 11, respectively, and the float members (foamed material) 49 are also provided on the rear faces of the inclined faces 35 and 37. The left and right wall faces 41 and 43 are extended substantially vertically from the outer sides 35*a* and 37*a* of the left and right inclined faces 35 and 37, respectively. Float members (foamed material) 49 are also provided individually on the rear faces of the wall faces 41 and 43.

At the rear half portion 11*a* from a middle portion of the body, the center 34 of the radius R1 of the arc of the keel 33 substantially coincides with the height of the position G of the center of gravity of the body 11. Consequently, since the center 34 of the radius R1 of the arc of the keel 33 can be positioned at a comparatively high position, the radius R1 of the arc is large.

Since the radius R1 of the arc of the keel 33 is large, the projecting amount by which the keel 33 projects downwardly from the body 11 can be kept small when compared with a keel 55 (indicated by imaginary lines) having a smaller arc radius.

Further, the center 34 of the arc of the keel 33 substantially coincides with the height of the position G of the center of gravity of the body 11. Consequently, when a crew-member 50 (refer to FIGS. 5(*a*) and 5(*b*)) performs a steering operation of the operation handle member 15 and the body 11 turns its direction from a forwardly advancing direction to a turning direction and is pushed by water from a sideward direction, whereupon the body 11 begins to be inclined toward the center of the turning movement, the body 11 inclines around the height of the position of the center of gravity. Therefore, the body 11 can incline readily toward the center of the turning movement.

FIG. 4(*b*) shows the radius R2 of the arc of the keel 33 which is set, at the front half portion 11*b* of the body 11, so as to gradually decrease forwardly from the center C (shown in FIGS. 3(*a*) and 3(*b*)) of the body 11. Since the radius R2 of the arc of the keel 33 is set so as to gradually decrease forwardly, the keel 33 at the front half portion 11*b* can be made project by a comparatively great amount from the bottom 30. Consequently, the plowing property by the keel 33 when the personal watercraft 10 advances straightforwardly can be improved.

Next, action of the personal watercraft 10 when it advances straightforwardly is described with reference to FIGS. 5(*a*) and 5(*b*).

Figure 5A:
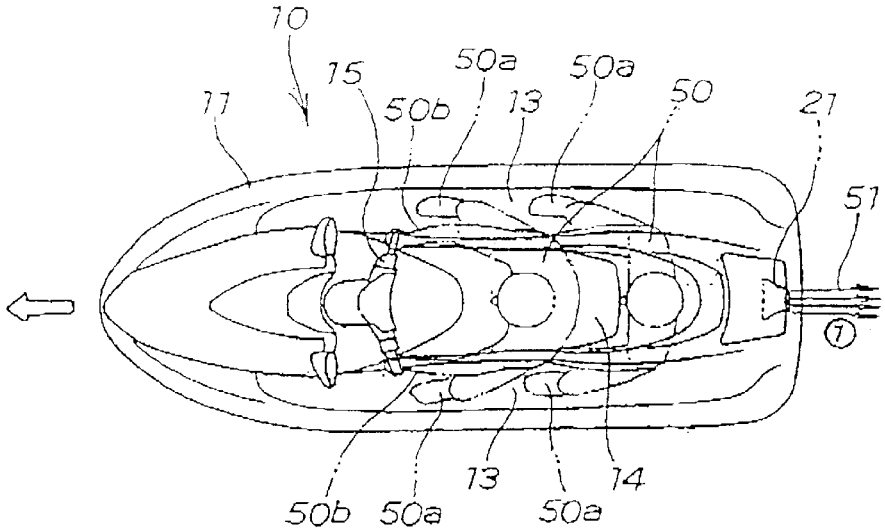
FIGS. 5(*a*) and 5(*b*) are views illustrating action of the personal watercraft according to the present invention when it glides straightforwardly.
Figure 5B:
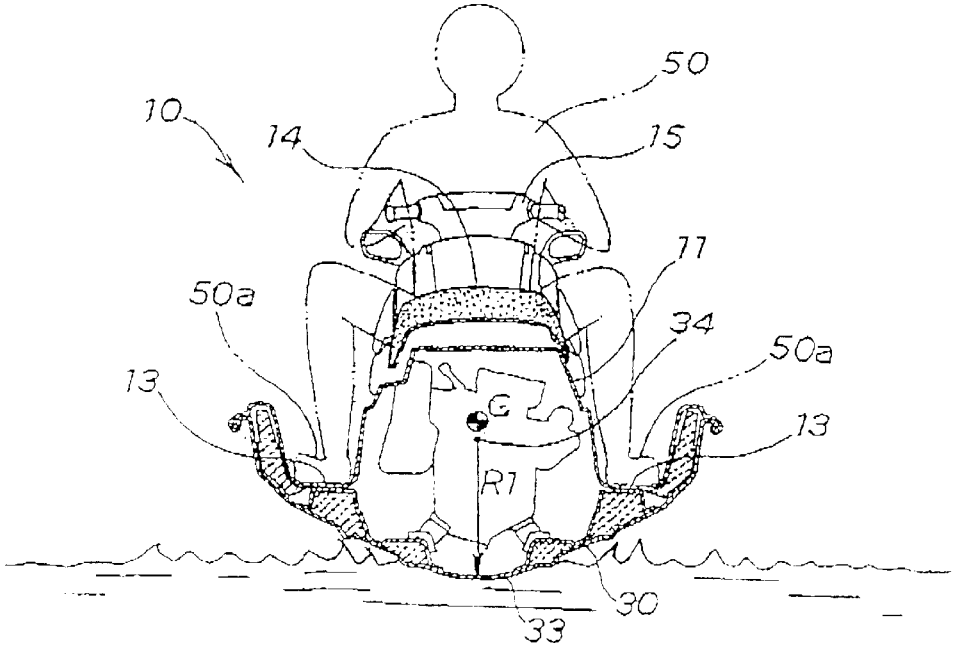

FIGS. 5(*a*) and 5(*b*) are views illustrating action of the personal watercraft according to the present invention when it advances straightforwardly. In the following, description is given of an example wherein the personal watercraft 10 is a two-seater watercraft. However, the watercraft according to the present invention is not limited to a two-seater watercraft.

Referring to FIG. 5(*a*), two crew-members 50 ride on the seat 14 with the left and right feet 50*a* placed on the left and right foot decks 13, respectively, and one of the crew-members 50 grips the operation handle member 15 with the left and right hands 50*b* to steer the personal watercraft 10.

In this condition, as the operation handle member 15 is kept in a straightforwardly advancing condition, a water jet 51 is jetted rearwardly as indicated by an arrow mark 1 from the steering nozzle 21 attached to the rear end of the water jet propeller 20 (shown in FIG. 1). As the water jet 51 is jetted, the personal watercraft 10 is advanced straightforwardly as indicated by an open arrow mark.

In FIG. 5(*b*), as the radius R1 of the arc of the keel 33 is made large to suppress the projecting amount of the keel 33, it is possible to prevent the keel 33 from being influenced by a side wave. Consequently, the personal watercraft 10 can be prevented from being rolled leftwardly or rightwardly by an influence of a side wave.

It is to be noted that, if the speed of the personal watercraft is raised while it is advancing straightforwardly, then it enters a gliding state, in which only the rear half portion of the body 11 touches with the water while the front half portion of the body 11 is spaced away from the water.

When ripples are present on the water, the ripples hit only the rear half portion of the body 11. However, if a high wave is present on the water, then the wave also hits the front portion of the body 11. Since the front half portion of the body 11 is formed such that the radius of the arc of the keel gradually decreases forwardly, the front half portion, which is hit by a high wave, is superior in plowing property and the impact provided from the high wave can be reduced. As such, driving comfort is improved.

Subsequently, action of the personal watercraft 10 upon turning is described with reference to FIGS. 6(*a*), 6(*b*), and FIGS. 7(*a*), and 7(*b*).

Figure 6A:
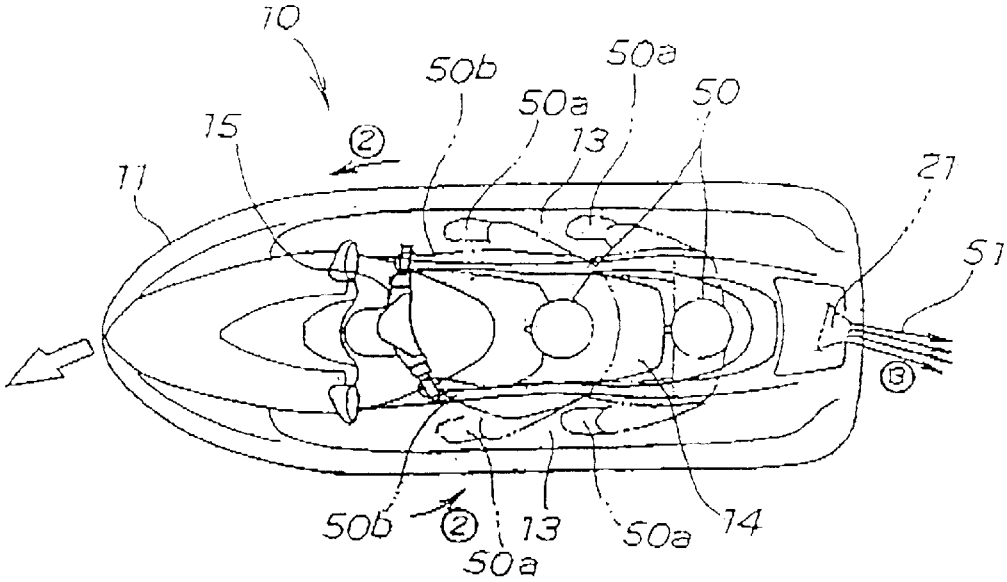
FIGS. 6(*a*) and 6(*b*) are views illustrating first action of the personal watercraft according to the present invention when it is turned.
Figure 6B:
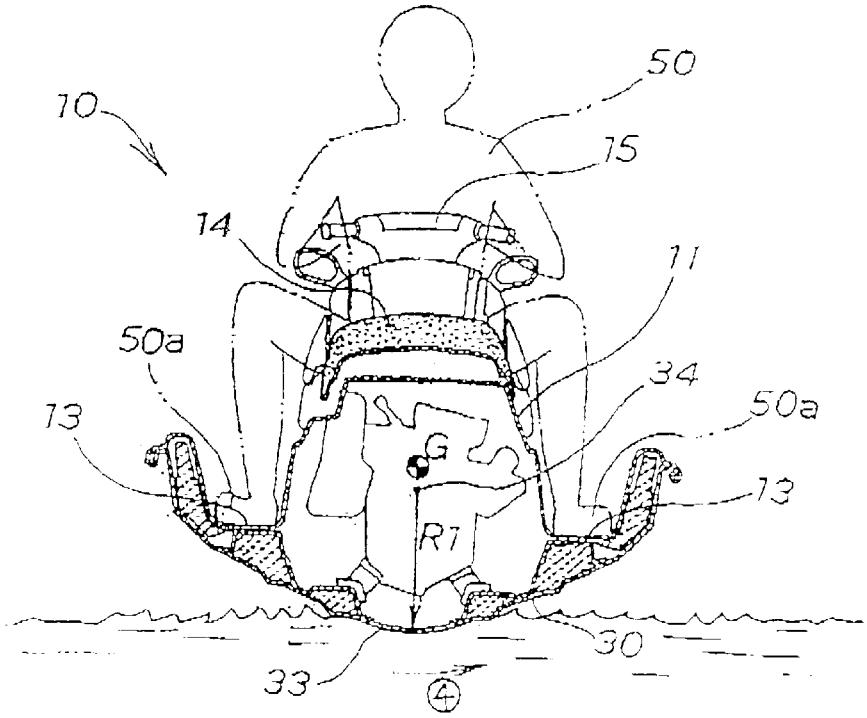

FIGS. 6(*a*) and 6(*b*) are views illustrating first action when the personal watercraft according to the present invention is turned.

Referring to FIG. 6(*a*), two crew-members 50 ride on the seat 14 with the left and right feet 50*a* placed on the left and right foot decks 13, respectively. One of the crew-members 50 grips the operation handle member 15 with the left and right hands 50*b* to steer the personal watercraft 10.

Thereupon, the crew-member 50 operates the operation handle member 15 in such a manner as indicated by an arrow mark 2 to swingably move the steering nozzle 21. Consequently, the direction of the water jet jetted from the steering nozzle 21 is inclined as indicated by an arrow mark 3.

In FIG. 6(*b*), when the direction of the water jet jetted from the steering nozzle 21 is inclined as indicated by the arrow mark 3 (indicated in FIG. 6(*a*)), simultaneously the crew-member 50 (refer to FIGS. 5(*a*) and 5(*b*)) operates to steer the operation handle member 15 to a turning condition.

Here, since the center 34 of the arc of the keel 33 substantially coincides with the height of the position G of the center of gravity of the body 11, the personal watercraft 10 inclines as indicated by an arrow mark 4 around the position G of the center of gravity.

Figure 7A:
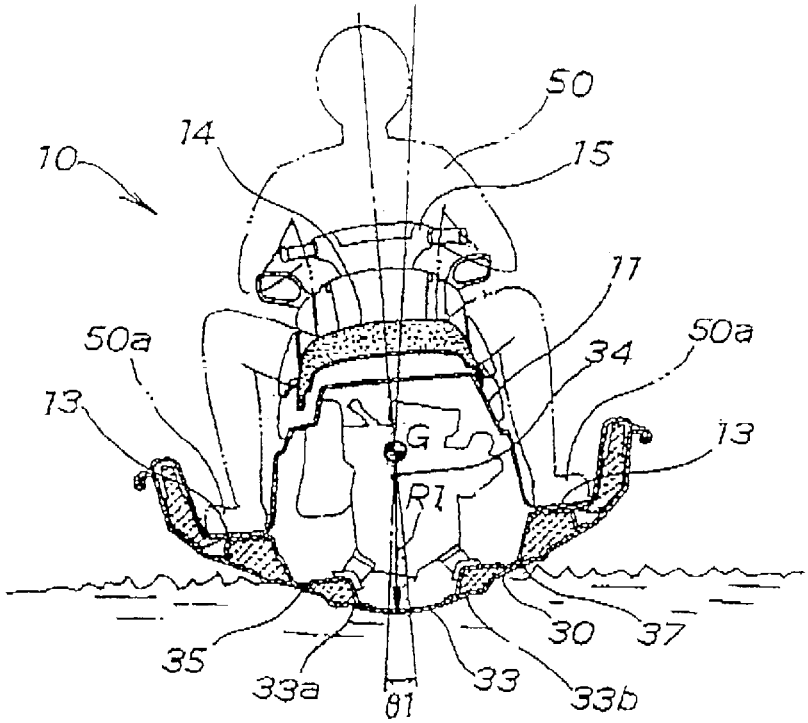
FIGS. 7(*a*) and 7(*b*) are views illustrating second action of the personal watercraft according to the present invention when it is turned.
Figure 7B:
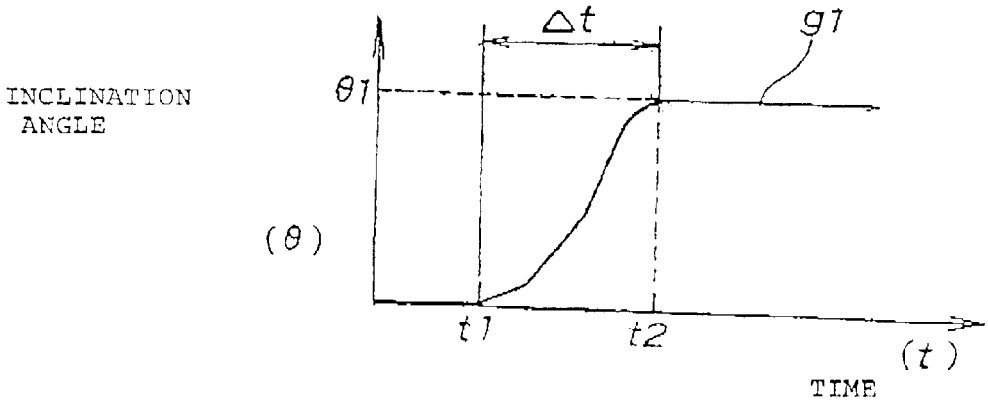
Figure 8:
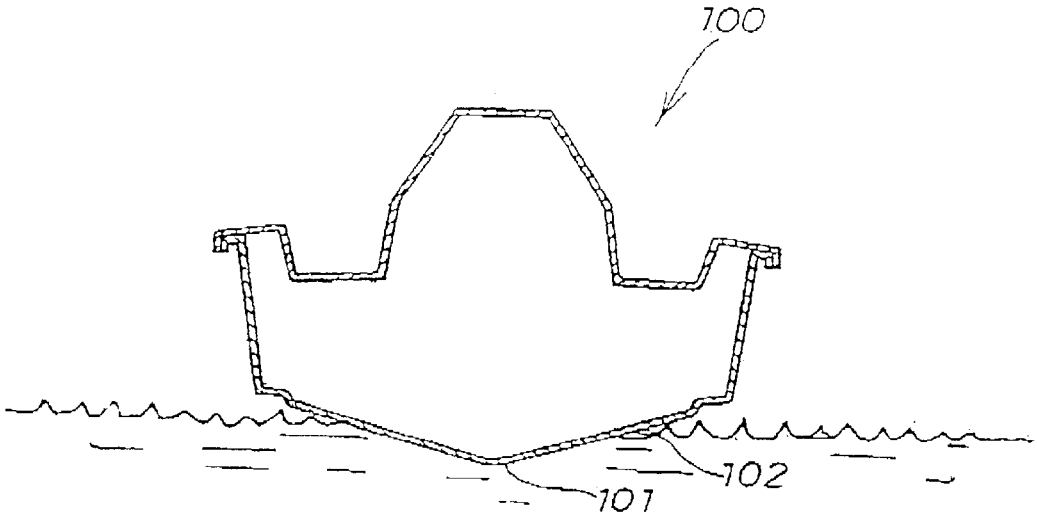
FIG. 8 is a sectional view of a conventional personal watercraft.
Figure 9:
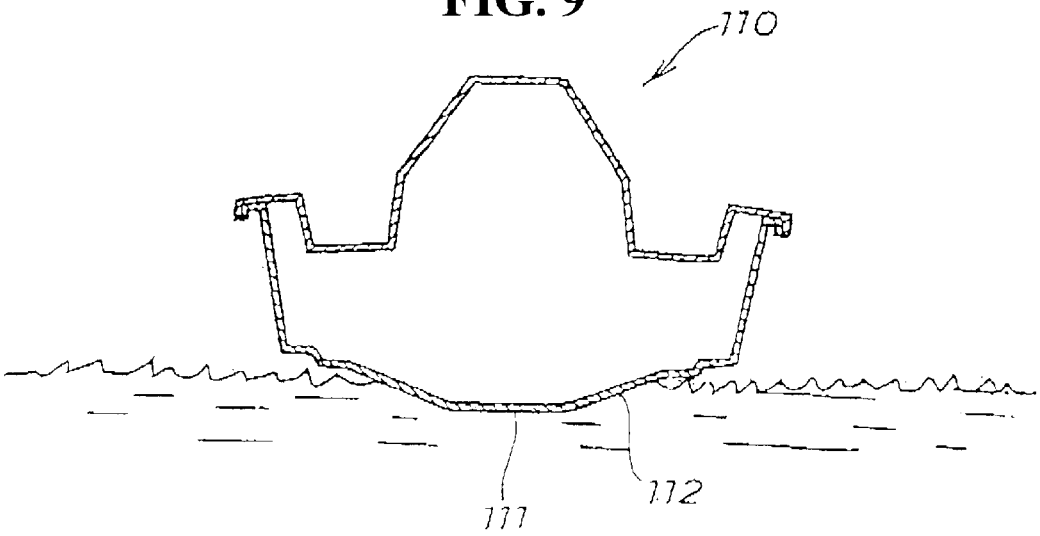
PRIOR ART FIG. 9
FIG. 9 is a sectional view showing another example of a conventional personal watercraft.
Figure 10:
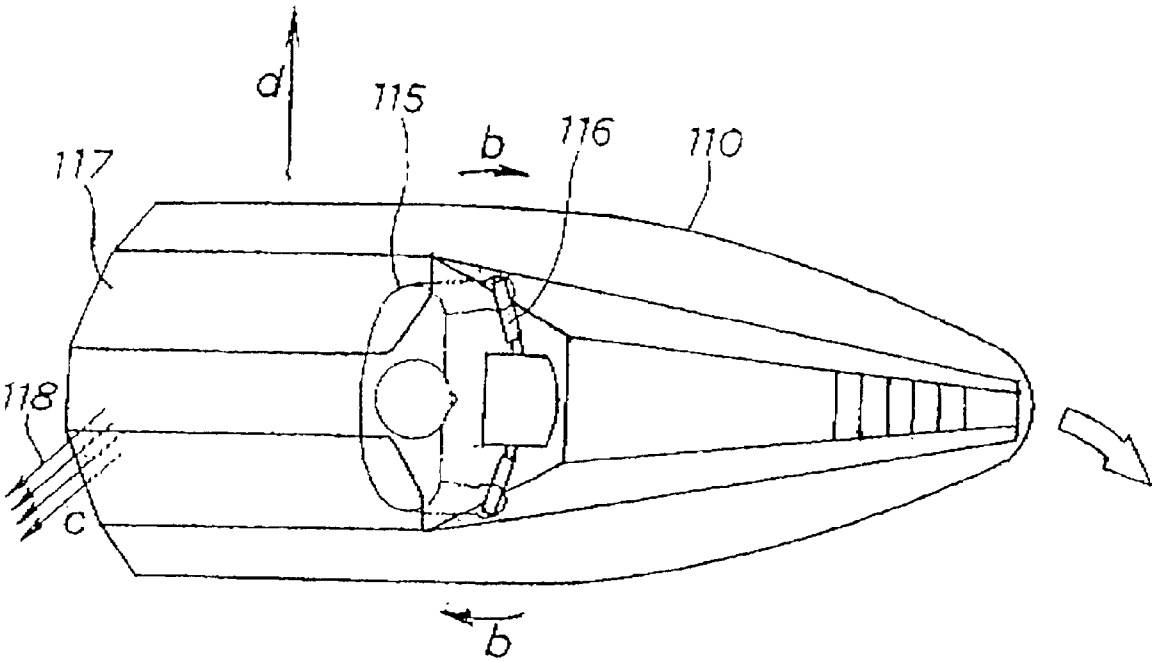
FIG. 10 is a plan view showing the other example of a conventional personal watercraft.

FIGS. 7(*a*) and 7(*b*) are views illustrating second action of the personal watercraft according to the present invention when it is turned.

In FIG. 7(*a*), if the personal watercraft 10 inclines as indicated by the arrow mark 4 (indicated in FIG. 6(*b*)) around the position G of the center of gravity and the personal watercraft 10 is kept in a state wherein it inclines by a predetermined angle θ1, then the personal watercraft 10 can be turned suitably.

FIG. 7(*b*) is a graph illustrating the inclination time of the personal watercraft 10 when the personal watercraft 10 is turned. From this graph g1, it can be seen that the personal watercraft 10 is inclined over a period of time Δt from inclination starting time (t1) to inclination ending time (t2).

This indicates that, when the crew-member 50 steers so as to turn the personal watercraft 10, the body 11 turns its direction and is pushed by water from a sideward direction so that the body 11 begins to incline relatively fast. Thereafter, the left and right inclined faces 35 and 37 extending respectively, continuously from the left and right sides 33*a* and 33*b* of the keel 33 linearly to the outer sides of the body 11 act as resistance, thereby slowing down the inclining process toward the end of the period of time Δt.

Consequently, since the personal watercraft 10 inclines in accordance with a steering condition of the crew-member 50, the personal watercraft 10 can incline smoothly to the turning center side by a natural movement.

Accordingly, the personal watercraft 10 can be turned with the same sense of operation as is experienced when turning a motorcycle. Thus, the turning operability of the personal watercraft 10 is improved.

On the other hand, if the keel 55 indicated by imaginary lines in FIG. 4(*a*) were to be formed on the bottom, the keel 55 would project by a comparatively great amount downwardly from a middle portion of the bottom 102. Consequently, if the crew-member 50 were to steer the operation handle member 15 in order to turn the personal watercraft 10, the movement when the body 11 would begin to incline slowing. Then, after the body 11 had begun to incline, the personal watercraft 10 would incline suddenly to the turning center side.

Consequently, since some displacement occurs between the steering of the crew-member 50 and the inclination movement of the body 11, the personal watercraft 10 would not incline smoothly to the turning center side by a natural movement. Accordingly, the personal watercraft 10 could not be turned with the same sense as the sense of operation of a motorcycle.

It is to be noted that, while, the personal watercraft 10 of the present invention is a two-seater watercraft, the present invention is not limited to this. Similar effects can be achieved also with such personal watercrafts as a one-seater watercraft or a three-seater watercraft.

Further, while the personal watercraft 10 of the present invention takes in and propels water by means of a water jet propeller, as an example, the propulsion for the watercraft is not limited to this.

The present invention exhibits the following effects due to the configuration described above.

According to the first aspect of the present invention, at the portion of the body rearwardly of the center of the body, the center of the arc of the keel substantially coincides with the height of the position of the center of gravity of the body. Consequently, the radius of the arc of the keel can be made large. Since the radius of the arc of the keel is large, the keel does not project downwardly by a great amount from the bottom.

Since the projecting amount of the keel is limited in this manner, the keel is less likely to be influenced by a side wave. Thus, the body is prevented from rolling leftwardly or rightwardly by an influence of a side wave.

Further, since the keel does not project downwardly by a great amount from the bottom, and the center of the arc of the keel substantially coincides with the height of the position of the center of gravity of the body, when a crew-member performs a steering operation upon turning, the body inclines to the center of the turning movement in accordance with the steering condition.

Consequently, since the body inclines smoothly toward the center of the turning movement by a natural movement, the personal watercraft can be turned with a sense similar to the sense of operation of a motorcycle.

According to the second aspect of the present invention, since, at the portion of the body forwardly of the center of the body, the radius of the arc of the keel gradually decreases forwardly, the keel at the portion of the body forward of the center of the body can be made project by a comparatively great amount from the bottom.

Consequently, since the plowing property by the keel when the personal watercraft advances straightforwardly can be improved, when the body is hit by a high wave while the personal watercraft glides, the impact provided to the body can be kept low, and driving comfort can be improved.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A personal watercraft comprising:

a saddle type seat extending in a forward and backward direction at a middle portion of a deck of a body;

an operation handle member provided forwardly of said seat, a pair of foot decks formed on the opposite sides of said seat; and a keel provided on a bottom of said body and extending in a forward and backward direction from a bow to a stern, said keel bulging downward and formed in an convex arc shape when viewed from the outside, wherein a center of the arc of said keel substantially coincides with a vertical position of a center of gravity of said body at a location rearward of a center of said body in a longitudinal direction.

2. The personal watercraft according to claim 1, wherein a radius of the arc of said keel gradually decreases forwardly at a location forward of the center of said body in the longitudinal direction.

3. The personal watercraft according to claim 1, further comprising:

a pair of left and right inclined faces extending outwardly in a widthwise direction from respective left and right sides of the keel; and a pair of left and right wall faces extending substantially vertically from an outer side of the left inclined face and an outer side of the right inclined face, respectively.

4. The personal watercraft according to claim 3, wherein the left and right inclined faces respectively provided on the left and right sides of the keel form left and right inner side chines on inner sides of the inclined faces, respectively.

5. The personal watercraft according to claim 3, wherein left and right central chines are formed at middle portions of the left and right inclined faces, and left and right outer side chines are formed on the outer sides of the inclined faces, respectively.

6. The personal watercraft according to claim 2, wherein the radius of the arc of the keel forward of the center of the body is smaller than a radius of the arc rearward of the center of the body.

7. The personal watercraft according to claim 3, wherein the watercraft inclines to a predetermined angle θ1 when an operator steers so as to turn the personal watercraft, the body initially inclining relatively fast toward the predetermined angle θ1, and then inclining more slowly as the predetermined angle θ1 is reached due to resistance provided by the left and right inclined faces extending continuously from the left and right sides of the keel.

8. A personal watercraft comprising a saddle type seat extending in a forward and backward direction at a middle portion of a deck of a body, an operation handle member provided forwardly of said seat, a pair of foot decks formed on the opposite sides of said seat, and a keel provided at a middle portion of a bottom of said body and extending from a bow to a stern, said keel being formed in an arc, wherein a center of the arc of said keel extending in a forward and backward direction of said body substantially coincides with a vertical position of a center of gravity of said body at a location rearward of a center of said body in a longitudinal direction.

9. The personal watercraft according to claim 8, wherein the radius of the arc of said keel gradually decreases forward at a location forward of the center of said body in the longitudinal direction.

10. The personal watercraft according to claim 8, further comprising:

a pair of left and right inclined faces extending outwardly in a widthwise direction from respective left and right sides of the keel; and a pair of left and right wall faces extending substantially vertically from an outer side of the left inclined face and an outer side of the right inclined face, respectively.

11. The personal watercraft according to claim 10, wherein the left and right inclined faces respectively provided on the left and right sides of the keel form left and right inner side chines on inner sides of the inclined faces, respectively.

12. The personal watercraft according to claim 10, wherein left and right central chines are formed at middle portions of the left and right inclined faces, and left and right outer side chines are formed on the outer sides of the inclined faces, respectively.

13. The personal watercraft according to claim 9, wherein the radius of the arc of the keel forward of the center of the body is smaller than a radius of the arc rearward of the center of the body.

14. The personal watercraft according to claim 10, wherein the watercraft inclines to a predetermined angle θ1 when an operator steers so as to turn the personal watercraft, the body initially inclining relatively fast toward the predetermined angle θ1, and then inclining more slowly as the predetermined angle θ1 is reached due to resistance provided by the left and right inclined faces extending continuously from the left and right sides of the keel.

* * * * *